US006318930B1

(12) United States Patent
Scudder

(10) Patent No.: US 6,318,930 B1
(45) **Date of Patent: *Nov. 20, 2001**

(54) EFFICIENT METHOD AND PULVERIZER FOR PIPELINE TRENCH PADDING

(76) Inventor: Erik D. Scudder, c/o Scudder & Co., 575 Lexington Ave., New York, NY (US) 10022

( * ) Notice: Subject to any disclaimer, the term of this patent is extended or adjusted under 35 U.S.C. 154(b) by 0 days.

This patent is subject to a terminal disclaimer.

(21) Appl. No.: 09/253,567

(22) Filed: Feb. 19, 1999

Related U.S. Application Data

(63) Continuation-in-part of application No. 08/504,685, filed on Jul. 20, 1995, now Pat. No. 5,938,373.

(51) Int. Cl.[7] ..... F16L 1/028; F16L 3/02

(52) U.S. Cl. ..... 405/179; 37/43; 37/142.5; 37/360; 37/391

(58) Field of Search ..... 405/179; 37/142.5, 37/303, 304, 305, 306, 386, 391, 392, 189, 190, 359, 360, 93, 95; 241/101.742, 8, 68; 404/91

(56) References Cited

U.S. PATENT DOCUMENTS

| | | | | |
|---|---|---|---|---|
| Re. 31,818 | * | 1/1985 | Clonch | 241/101.74 |
| 1,901,523 | * | 3/1933 | Millet | 404/91 X |
| 3,091,873 | * | 6/1963 | West | 172/66 |
| 3,452,461 | * | 7/1969 | Hanson | 404/91 |
| 3,503,450 | * | 3/1970 | Day | 37/142.5 X |
| 3,934,363 | * | 1/1976 | McMurray | 37/142.5 X |
| 4,185,875 | * | 1/1980 | Swisher, Jr. et al. | 404/91 X |
| 4,283,867 | * | 8/1981 | Brown | 37/142.5 |
| 4,676,688 | * | 6/1987 | Caradot | 404/91 |
| 4,864,748 | * | 9/1989 | Boyer | 37/142.5 |
| 4,912,862 | * | 4/1990 | Bishop et al. | 37/142.5 |
| 4,961,542 | * | 10/1990 | Den Besten et al. | 241/101.74 |
| 5,084,991 | * | 2/1992 | Cronk, Jr. | 405/179 X |
| 5,430,962 | * | 7/1995 | Osadchuk | 405/179 X |
| 5,441,361 | * | 8/1995 | Campbell | 404/91 X |
| 5,694,709 | * | 12/1997 | Cronk, Jr. et al. | 37/142.5 |
| 5,788,168 | * | 8/1998 | Gilbert et al. | 241/101.742 |
| 5,823,707 | * | 10/1998 | Lodovico | 404/91 |
| 5,860,533 | * | 1/1999 | Wood | 209/308 |
| 5,988,937 | * | 11/1999 | Komoriya et al. | 404/91 X |

* cited by examiner

*Primary Examiner*—Christopher J. Novosad
(74) *Attorney, Agent, or Firm*—Greenberg Traurig, LLP

(57) ABSTRACT

A trench-padding method and apparatus provide a more efficient, cost efficient process of obtaining a maximal amount of padding material from material excavated from a trench, and where selected, provide for trenching. The trench-padding apparatus includes a lead assembly that includes a feeder housing having a front rotating unit with protrusions. The feeder housing may be configured to excavate the trench or alternatively, to scoop up previously excavated material. The front rotating unit is attached to a frame of the trench-padding apparatus immediately in front of an elevator device, and the front rotating unit forces clumps of the excavated material between the front rotating unit and a base of the feeder housing to aid in reducing clump size. The method operates in the manner of the trench-padding apparatus.

27 Claims, 4 Drawing Sheets

EFFICIENT METHOD AND PULVERIZER FOR PIPELINE TRENCH PADDING

This is a Continuation-In-Part of U.S. patent application Ser. No. 08/504,685 by Erik D. Scudder, filed on Jul. 20, 1995, now U.S. Pat. No. 5,938,373.

BACKGROUND OF THE INVENTION

1. Field of the Invention

The present invention relates to preparation of trenches for laying underground pipelines and more particularly, to efficient preparation of trenches for laying underground pipelines.

2. Description of the Related Art

Typically, underground pipelines are used to deliver oil and gas products and other products, e.g., coal slurries and water, in the world-wide pipelining industry. Pipelines often must be laid in remote or undeveloped areas. Also, frequently pipelines must be laid in climates with extreme weather, such as Alaska. These soil conditions may make construction of pipelines difficult.

Trenches are dug to allow the pipelines to be placed underground, thus aiding in protecting them from the environment and avoiding obstructions such as rivers, bridges, railroad tracks, etc. Typically, when a pipeline is to be laid, a machine excavates a trench, delivering the excavated soil and rocks to one side of the trench, the excavated material forming a row of "spoil" along the side of the trench. The pipeline requires padding along the base of the trench to protect against damage from rough, sharp or pointed rocky materials that may be present along the lower portion of the trench. After placement of the pipeline, another layer of padding material is added on top of the pipeline to protect it further.

Care must be taken to surround the pipeline with trench filling that will not damage the pipeline. The pipelines are also covered with a cathodic coating to protect the pipe from rust and corrosion. Rocky material may damage the coating of the pipeline. Thus, the "padding" that constitutes the trench filling must be a fine material such as sand or fine soil that will maintain the integrity of the pipe.

As is known in the art, the padding material may be shipped to the pipeline construction area and then used to cushion the bottom of the trench and as protective filling around the pipe. The problem with this approach is that it is usually quite costly to transport the padding material. The distance for transport is usually considerable and the terrain may make transportation difficult. Also, there is an added labor cost for transporting the padding material.

In an attempt to lower the cost of transporting padding material to the pipeline construction site, in some instances, pulverizing machines have been conveyed to the construction site. Material from the site of construction was typically pulverized, screened to remove larger particles, and then used for padding material.

U.S. Pat. Nos. 3,701,422 and 4,633,602 relate to machines that move along the trench, picking up and screening the excavated material, and placing it on a longitudinally extending, rearwardly inclined conveyor that deposits the screened material on top of the pipeline as cover padding. Unfortunately, simply retrieving and screening the material that is excavated often does not provide sufficient material to pad the trench adequately.

However, the prior art techniques fail to maximize extraction of padding material from the excavated material. There is a need to provide an apparatus and method for obtaining a maximal amount of padding material from the excavated material so that a more efficient, cost effective process is achieved.

SUMMARY OF THE INVENTION

The present invention provides an apparatus and an associated method for efficiently and cost-effectively obtaining a maximal amount of trench-padding material from material excavated from the trench. One embodiment provides a trench-padding apparatus and method with a lead assembly mounted on the front of the apparatus, wherein the lead assembly may be pivoted and raised and lowered to facilitate pickup of excavated material. The lead assembly has a feeder housing and rotating unit that may be a drum/barrel with protrusions that aids in breaking up clumps of excavated material. The protrusions are generally stubby teeth, sharp teeth or blades, arranged at predetermined intervals to maximize excavation material clump-breaking. Generally, the rotating unit is coupled to the frame immediately in front of an elevator device and is configured to force excavated material between teeth/blades of the rotating drum/barrel and the surface of the base of the feeder housing. The front end of the elevator device is positioned to receive the excavated material, and the rear end of the elevator device is positioned to deliver the excavated material to a first mesh screen. Usually, the elevator device is at least partially protected by a detachable cover.

A rotating drum at the rear of the trench-padding device is attached to the frame and rotates in a direction to increase backward flow of the particles too large to pass through the mesh screen to avoid material buildup.

In one embodiment the method of the present invention includes the steps of: A) using a trench-padding apparatus that includes a lead assembly with a feeder housing to pick up the excavated material; and B) using a front rotating unit with protrusions, the front rotating unit being attached to a frame of the trench-padding apparatus immediately in front of an elevator device to force clumps of the excavated material between the front rotating unit and a base of the feeder housing to aid in reducing clump size. Generally, using the front rotating unit includes using a rotating drum with protrusions that are blades, fingers, or teeth. A detachable cover may protect at least part of the elevator device from rain, snow and the like. In addition, where selected, the method may include using a rear rotating unit, pivotally attached to a rearward portion of the frame of the trench-padding apparatus, that rotates in a direction to increase backward flow of excavation material too large to be used as padding material.

In another embodiment, the trench-padding-excavating apparatus is additionally configured to provide for excavation, and performs as a trench-padding-excavation apparatus. In this embodiment, the trench-padding-excavating apparatus includes a lead assembly having a feeder housing configured to excavate material, with a feeder housing having a front rotating unit with protrusions, wherein the front rotating unit is attached to a frame of the trench-padding-excavating apparatus immediately in front of an elevator device, and the front rotating unit forces clumps of the excavated material between the front rotating unit and a base of the feeder housing to aid in reducing clump size.

In one embodiment, the apparatus of the present invention provides efficient and cost-effective excavation of a trench and maximizes conversion of excavated material to trench-padding material. The apparatus includes: a frame adapted for movement along or astride a trench being formed by the apparatus; a lead assembly, having a feeder housing configured to excavate the trench and having a rotating toothed/bladed drum that is attached to the frame immediately in front of an elevator device, for retrieving and pulverizing the excavated material; the elevator device, being attached to the frame immediately behind the drum, for receiving and transporting the excavated material to at least a first mesh screen; the at least first mesh screen, attached to the frame and situated to receive the excavated material from the elevator device, for separating the excavated material into at least two grades of material; a conveyor for transporting material that passes through the at least first mesh screen to the trench; and a pulverizer and conveyor for pulverizing and transporting material that fails to pass through the at least first mesh screen.

DETAILED DESCRIPTION OF PREFERRED EMBODIMENTS

Figure 1:
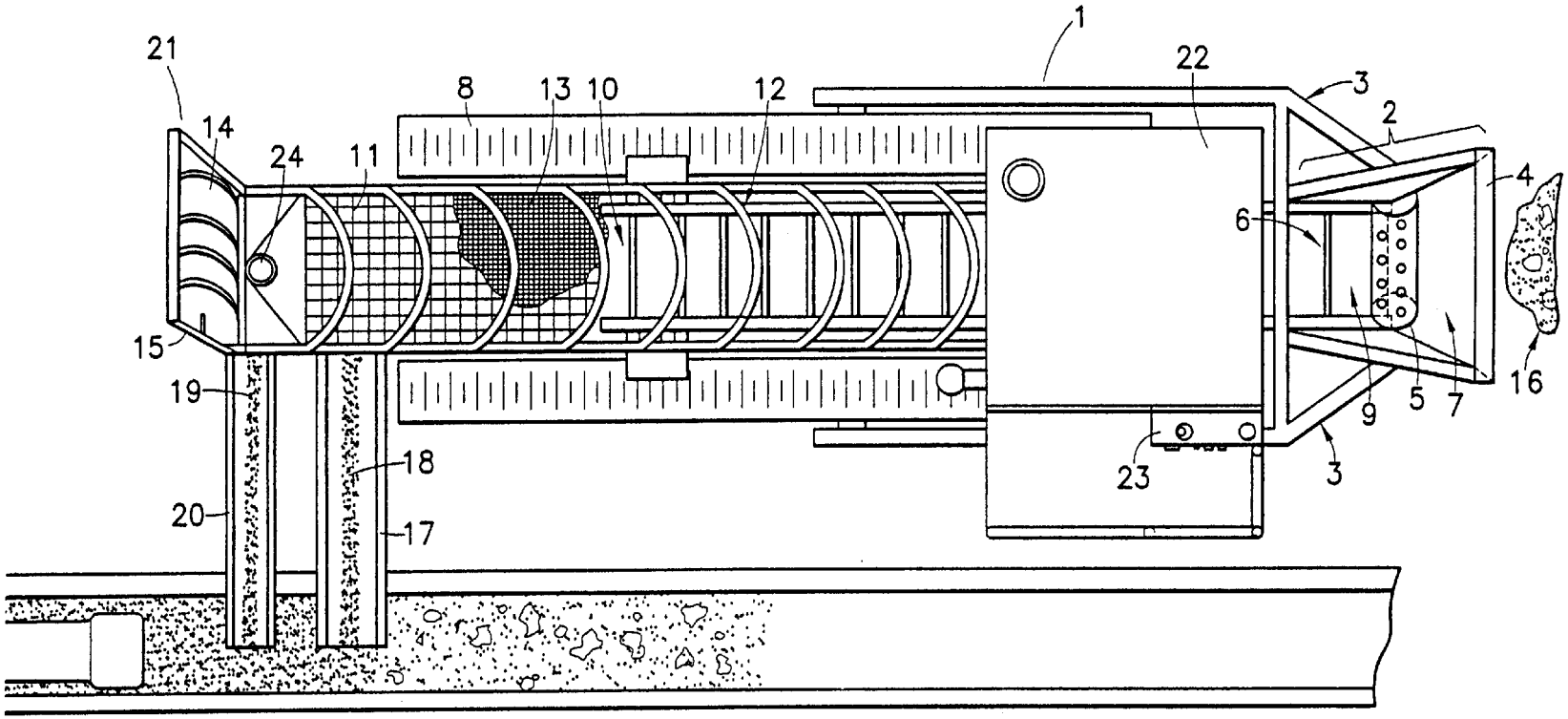
FIG. 1 is a schematic top-plan view of one embodiment of an apparatus in accordance with the present invention.

The present invention provides a trench-padding apparatus 1 and method 302,304 that efficiently and cost-effectively maximize conversion of excavated material to trench-padding material. As shown in FIG. 1, typically a lead assembly 2 for directing the apparatus in picking up excavated material 16 is pivotally mounted to a front end of a frame of the apparatus and is operated using lever arms and hydraulic pistons 3. The lead assembly 2 constitutes a feeder housing 4, often being scoop-shaped and with an adjustable height to control the pickup of the excavated material. In one embodiment the lead assembly 3 includes a toothed or, alternatively, bladed rotating drum/barrel 5 that aids in breaking up clumps of excavated material. Typically, the rotating drum/barrel 5 is coupled to the frame immediately in front of an elevator device 6, and is configured to break up clumps of excavated material as the material is forced between the teeth/blades of the rotating drum/barrel 5 and the surface of the base 7 of the feeder housing. For example, when the excavated material is frozen trundra, the rotating drum/barrel typically utilized is the rotating drum/barrel with blades situated to process the frozen tundra optimally.

The lead assembly 2 is coupled to the elevator device 6, typically a belt-type elevator with paddles, that is mounted to the frame 15 of the trench-padding apparatus 1. The trench-padding apparatus may, where selected, be mounted on tracks 8. The front end 9 of the elevator device 6 is positioned to receive the excavated material, and the rear end 10 of the elevator device 6 is positioned to deliver the excavated material to a first mesh screen 11. Where selected, the elevator device 6 may have a removable cover 12 that may be implemented, for example, in rainy or snowy weather, when the excavated material may become water-soaked and difficult to screen. Typically, the removable cover 12 attaches to the frame of the trench-padding apparatus 1. In a preferred embodiment, the at least first mesh screen 11 is generally approximately 3 inches by 3.5 inches and is coated with a preselected ceramic coating to avoid buildup of excavated material. Where selected, a second mesh screen 13 may be utilized. That is, a coarse mesh screen (the at least first mesh screen 11) may be situated above a finer mesh screen (the second mesh screen 13, the mesh size of which is selectable, but smaller than the mesh of the first mesh screen), with a collecting plate situated below the finer mesh screen (not shown) and angled to provide the finely meshed excavated material 19 to an adjustable speed conveyor 20. In the case of using two mesh screens, the coarse mesh screen is generally placed at a downward angle toward the rear to provide that particles too large to pass through the coarse mesh will be discarded parallel to the trench 21 by the rotating drum at the rear 14, and the meshed excavated material 18 that passes through the coarse mesh is provided, typically in a funneling manner, to a pulverizer 24 that reduces the size of the meshed excavated material 18 and passes it to a second adjustable speed conveyor 17, that conveys the material to the trench. Typically, the mesh screen or screens vibrate to facilitate the screening process.

The trench-padding apparatus typically includes a cab 22 where an operator is located, and controls 23 for controlling the operation of the trench-padding apparatus. The numerous modes of construction and operation of the cab 22, tracks 8, lever arms and hydraulic pistons 3, elevator 6, mesh screen(s) 11, 13, and adjustable speed conveyor(s) 18, 20 are known to those skilled in the art and will not be further described here.

Where a single mesh screen is utilized, the mesh screen is typically angled toward the rear at an angle that facilitates the transport of excavation material particles that are too large to pass through the mesh screen to a rear-mounted rotating unit/drum/barrel 14 that directs these particles at an angle away from the trench-padding apparatus. Where a coarse mesh screen and a fine mesh are utilized, the coarse mesh screen is typically angled toward the rear at an angle that facilitates the transport of the excavation material particles that are too large to pass through the coarse mesh screen to the rear-mounting rotating unit, drum or barrel 14.

Figure 2:
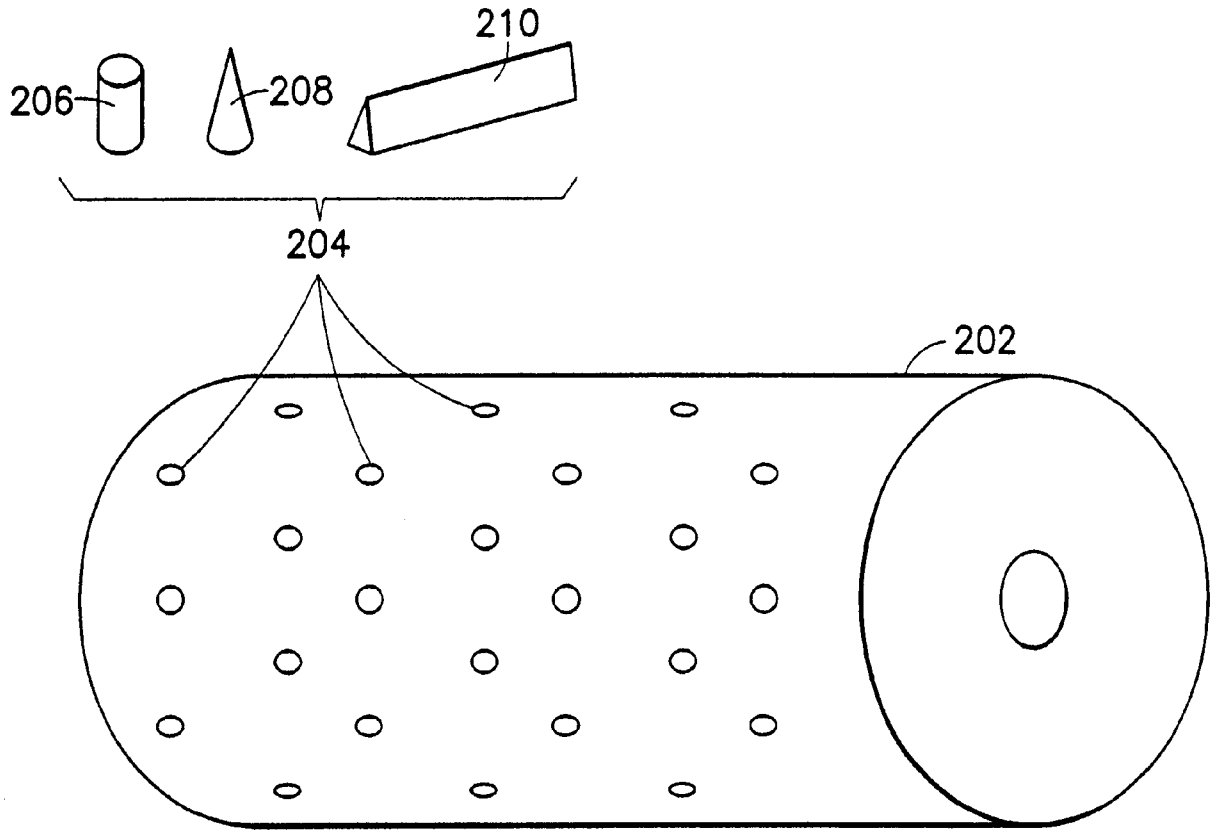
FIG. 2 is a schematic plan view of one embodiment of a rotating unit with protrusions at predetermined intervals, situated to process excavated material efficiently.

In a preferred embodiment, shown in FIG. 2, the rotating drum 202 at the front of the elevator has protrusions 204 such as blunt stubby teeth 206, pointed teeth 208, or blades 210, arranged at predetermined intervals on the rotating drum 202 to facilitate breaking up clumps of the excavated material. In a preferred embodiment where stubby teeth are utilized, the stubby teeth are approximately 2 inches long and 0.5 inches in diameter and are located at predetermined intervals along the drum. The rotating drum at the rear 14 is attached to the frame 15 of the apparatus and rotates in a direction to increase backward flow of the particles too large to pass through the mesh screen. In this fashion, buildup of the larger particles of excavating materials is avoided at the rear of the apparatus.

Where the coarse mesh screen, the fine mesh screen and the collecting plate are utilized, both of the mesh screens and the collecting plate are typically angled toward the rear at an angle that facilitates the transport of the excavating materials on them to their respective destinations. The particles on the coarse mesh screen are transported to the rotating, rear-mounted drum (described above). The particles on the fine mesh screen are transported to the pulverizer, then to a first adjustable speed conveyor that delivers the particles to the trench. The particles on the collecting plate are typically transported to a second adjustable speed conveyor that delivers the particles to the trench. The coarse mesh screen is typically angled toward the rear to transport the excavation material particles that are too large to pass through the coarse mesh screen to the rotating, rear-mounted drum, while the particles that are too large to pass through the fine mesh screen are passed to the pulverizer and then to an adustable speed conveyor.

Clearly, in a preferred embodiment, the trench-padding apparatus of the present invention includes a lead assembly, with a feeder housing having a front rotating unit with protrusions, wherein the front rotating unit is attached to a frame of the trench-padding apparatus immediately in front of an elevator device. The front rotating unit forces clumps of the excavated material between the front rotating unit and a base of the feeder housing to aid in reducing clump size. The front rotating unit is generally a rotating drum with protrusions that are blades, fingers, or teeth. In addition, the elevator device is typically a belt-type elevator with paddles with a removable cover. Also, a rear rotating unit is generally pivotally attached to a rearward portion of the frame of the trench-padding apparatus and operates as described above.

Figure 3:
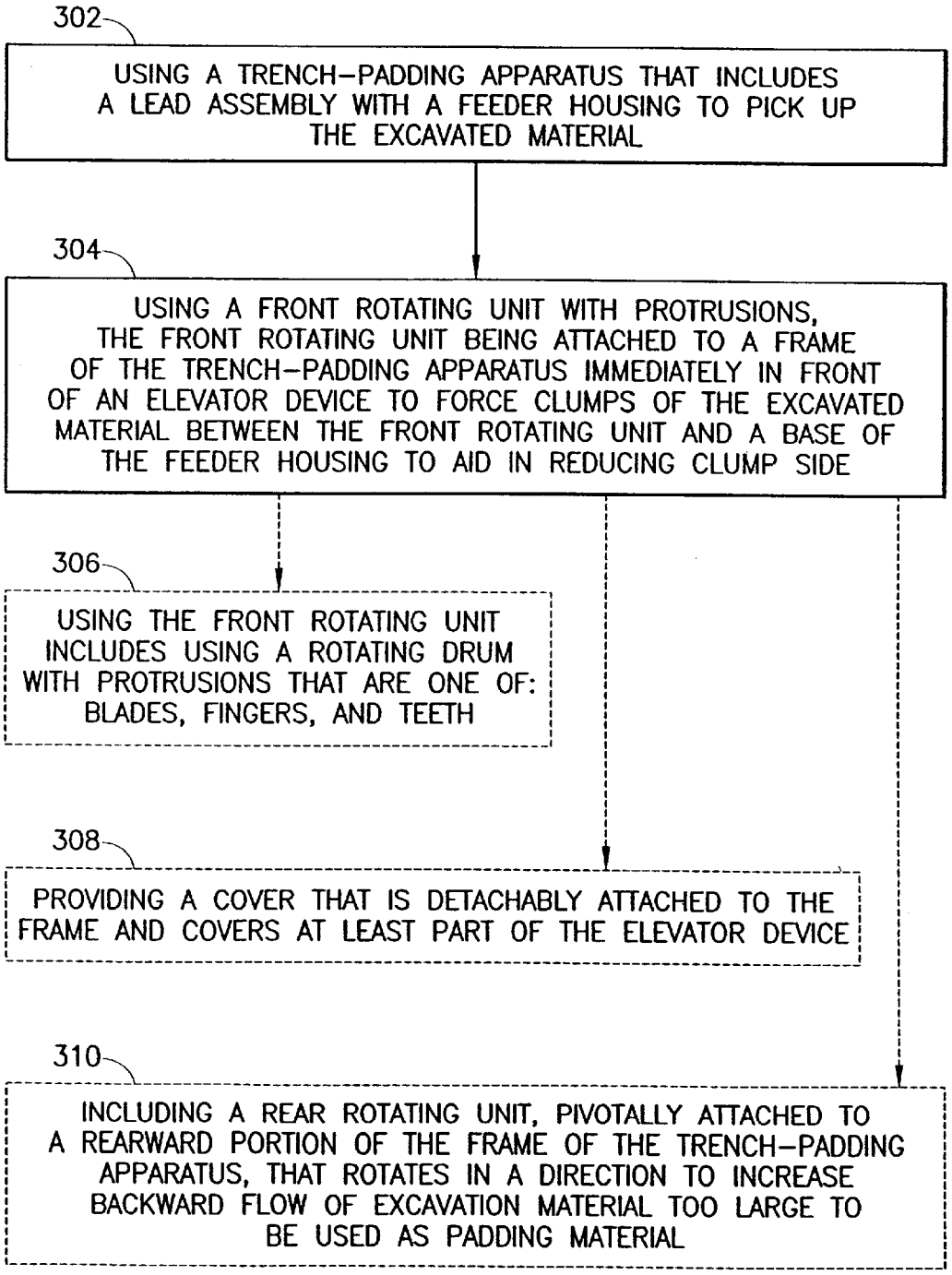
FIG. 3 is a flow chart showing one embodiment of steps in accordance with the method of the present invention

FIG. 3 is a flow chart showing one embodiment of steps in accordance with the method of the present invention. The present invention method for trench-padding provides for efficiently and cost-effectively maximizing conversion of excavated material to trench-padding material. The method includes the steps of: A) using 302 a trench-padding apparatus that includes a lead assembly with a feeder housing to pick up the excavated material; and B) using 304 a front rotating unit with protrusions, the front rotating unit being attached to a frame of the trench-padding apparatus immediately in front of an elevator device to force clumps of the excavated material between the front rotating unit and a base of the feeder housing to aid in reducing clump size. In a preferred embodiment, using the front rotating unit 304 includes using a rotating drum with protrusions 306 that are blades, fingers, or teeth. As with the trench-padding apparatus, the steps of the method may further include providing a cover that is detachably attached 308 to the frame and covers at least part of the elevator device. In addition, where selected, the method may include the step of including a rear rotating unit 310, pivotally attached to a rearward portion of the frame of the trench-padding apparatus, that rotates in a direction to increase backward flow of excavation material too large to be used as padding material.

Figure 4:
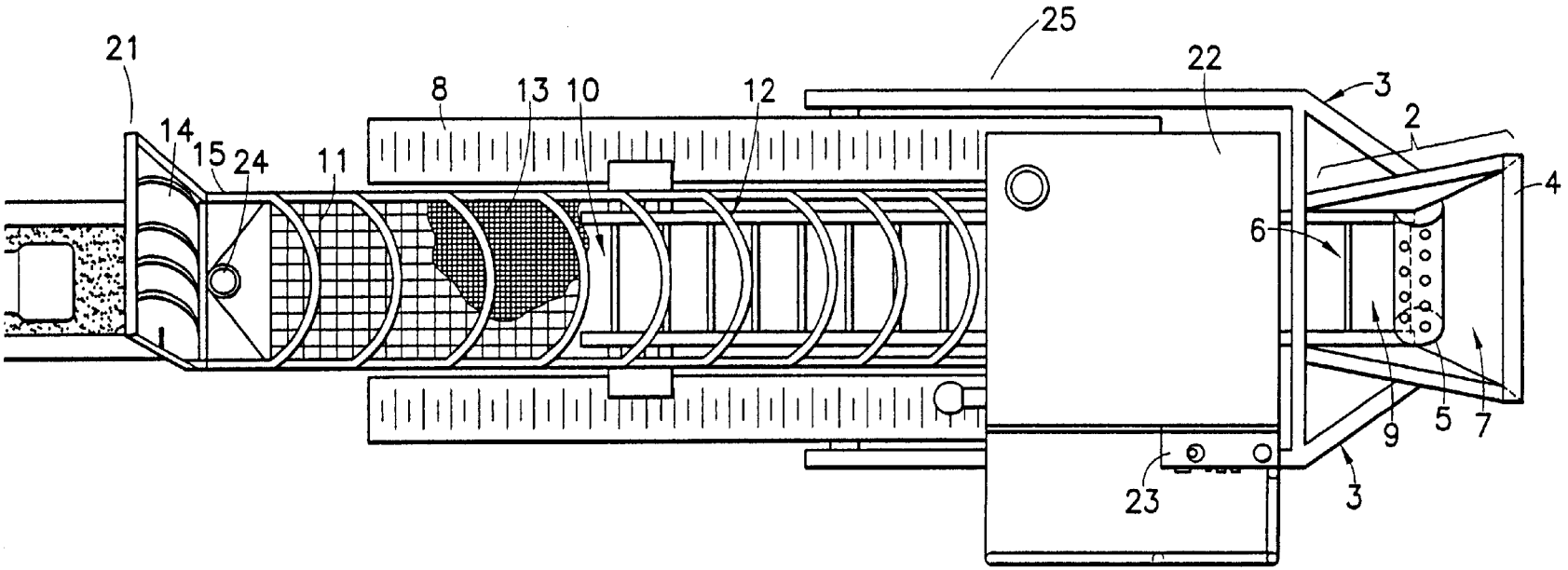
FIG. 4 is a schematic top-plan view of another embodiment of an apparatus in accordance with the present invention wherein the apparatus also provides excavation.

FIG. 4 is a schematic top-plan view of another embodiment of an apparatus in accordance with the present invention. In this embodiment, the trench-padding apparatus 1 also provides for excavation of the trench, becoming a trench-padding-trenching apparatus 25. Typically, as in FIG. 1, the lead assembly 2 for directing the apparatus in picking up excavated material 16 is pivotally mounted to a front end of a frame of the apparatus and is operated using lever arms and hydraulic pistons 3. However, in this embodiment, the apparatus is typically positioned astride the trench, i.e., the feeder housing 4 of the lead assembly 2 is configured to excavate material to create a trench of a predetermined depth. The leading edge of the feeder housing 4 may be selected to have a titanium edge for reinforcing the cutting edge of said housing 4. Alternatively, the leading edge of the housing may have teeth to facilitate excavation, and where selected, the teeth may be reinforced, for example, may be titanium-coated. In this embodiment, the trench-padding-excavating apparatus also provides for trenching and then operating as the apparatus described above, with the difference that the conveyors may be angled to convey the meshed and/or pulverized materials into the trench below the trench-padding-excavating apparatus, or, where selected, the conveyors may simply be eliminated, the apparatus dispensing the meshed and/or pulverized materials directly from the apparatus into the trench.

Although the present invention has been described in relation to particular preferred embodiments thereof, many variations and modifications and other uses will become apparent to those skilled in the art. It is preferred, therefore, that the present invention be limited not by the specific disclosure herein, but only by the appended claims.

What is claimed is:

1. A trench-padding apparatus for maximizing conversion of excavated material to trench-padding material, wherein the trench-padding apparatus includes a lead assembly, comprising a feeder housing having a front rotating unit with protrusions, wherein the front rotating unit is attached to a frame of the trench-padding apparatus immediately in front of an elevator device adapted to receive and transport said excavated material to at least a first mesh screen attached to said frame, said screen configured and adapted for separating the excavated material into at least two grades of material, wherein the front rotating unit is adapted to force clumps of the excavated material between the front rotating unit and a base of the feeder housing to aid in reducing clump size, and wherein said apparatus further comprises means for transporting material that fails to pass through said at least first mesh screen to a location removed from said screen.

2. The trench-padding apparatus of claim 1 wherein the front rotating unit is a rotating drum with protrusions that are one of: blades, fingers, and teeth.

3. The trench-padding apparatus of claim 1 wherein the elevator device is a belt-type elevator with paddles.

4. The trench-padding apparatus of claim 1 further including a cover that is detachably attached to the frame and covers at least part of the elevator device.

5. The trench-padding apparatus of claim 1 further including a rear rotating unit, pivotally attached to a rearward portion of the frame of the trench-padding apparatus, that rotates in a direction to increase backward flow of excavation material too large to be used as padding material.

6. An apparatus for maximizing conversion of excavated material to trench-padding material, comprising:

a frame adapted for movement along a trench being formed by the apparatus;

a lead assembly, comprising a feeder housing having a rotating toothed/bladed drum that is attached to the frame immediately in front of an elevator device, for retrieving and reducing clump size of the excavated material;

the elevator device, being attached to the frame immediately behind the drum, for receiving and transporting the excavated material to at least a first mesh screen;

the at least first mesh screen, attached to the frame and situated to receive the excavated material from the elevator device, for separating the excavated material into at least two grades of material;

means for transporting and pulverizing material that passes through the at least first mesh screen to the trench; and means for transporting material that fails to pass through the at least first mesh screen.

7. The apparatus of claim 6 wherein the elevator device is a belt-type elevator with paddles.

8. The apparatus of claim 6 further including a cover that is detachably attached to the frame and covers at least part of the elevator device and the mesh screen.

9. The apparatus of claim 6 wherein the at least first mesh screen is approximately 3 inches by 3.5 inches and is coated with a preselected ceramic coating.

10. The apparatus of claim 6 further including a second mesh screen having a mesh smaller than the mesh of the first mesh screen, wherein material that fails to pass through the second mesh screen is passed to a pulverizer, then to a first conveyor to the trench and wherein material that passes through the second mesh screen is passed to a second conveyor to the trench.

11. The apparatus of claim 6 wherein the means for transporting material that fails to pass through the at least first mesh screen is a rotating drum, attached to the frame of the apparatus, that rotates in a direction to increase backward flow of particles too large to pass through the at least first mesh screen.

12. A method for trench-padding that maximizes conversion of excavated material to trench-padding material, comprising the steps of:

using a trench-padding apparatus that includes a lead assembly with a feeder housing to pick up the excavated material;

using a front rotating unit with protrusions to a frame of the trench-padding apparatus immediately in front of to force clumps of the excavated material between the front rotating unit and a base of the feeder housing to aid in reducing clump size, the front rotating unit being attached to a frame of the trench-padding apparatus immediately in front of an elevator device adapted to receive and transport said excavated material to at least a first mesh screen attached to said frame, said screen configured and adapted for separating the excavated material into at least two grades of material; and transporting excavated material that fails to pass through said at least a first screen to a location removed from said screen.

13. The method of claim 12 wherein using the front rotating unit includes using a rotating drum with protrusions that are one of: blades, fingers, and teeth.

14. The method of claim 12 further including providing a cover that is detachably attached to the frame and covers at least part of the elevator device.

15. A trench-padding-excavating apparatus for maximizing conversion of excavated material to trench-padding material, wherein the apparatus comprises a lead assembly having a feeder housing, wherein the feeder housing is configured to excavate material and has a front rotating unit with protrusions, wherein the front rotating unit is attached to a frame of the apparatus immediately in front of an elevator device adapted to receive and transport said excavated material to at least a first mesh screen attached to said frame, said screen configured and adapted for separating the extracted material into at least two grades of material, wherein the front rotating unit is adapted to force clumps of the excavated material between the front rotating unit and a base of the feeder housing to aid in reducing clump size, and wherein said apparatus further comprises means for transporting material that fails to pass through said at least first mesh screen to a location removed from said screen.

16. The trench-padding-excavating apparatus of claim 15 wherein the front rotating unit is a rotating drum with protrusions that are one of: blades, fingers, and teeth.

17. The trench-padding apparatus of claim 15 wherein the elevator device is a belt-type elevator with paddles.

18. The trench-padding apparatus of claim 15 further including a cover that is detachably attached to the frame and covers at least part of the elevator device.

19. The trench-padding apparatus of claim 15 further including a rear rotating unit, pivotally attached to a rearward portion of the frame of the trench-padding apparatus, that rotates in a direction to increase backward flow of excavation material too large to be used as padding material.

20. The apparatus of claim 15 wherein the at least first mesh screen is approximately 3 inches by 3.5 inches and is coated with a preselected ceramic coating.

21. The apparatus of claim 20 further including a second mesh screen below the first mesh screen, wherein the second mesh screen has a mesh smaller than a mesh of the first mesh screen, wherein material that fails to pass through the second mesh screen is passed to a pulverizer, then to a first conveyor to the trench and wherein material that passes through the second mesh screen is passed to a second conveyor to the trench.

22. An apparatus for excavating a trench and maximizing conversion of excavated material to trench-padding material, comprising:

a frame adapted for movement along/astride a trench being formed by the apparatus;

a lead assembly, comprising a feeder housing configured to excavate the trench and having a rotating toothed/bladed drum that is attached to the frame immediately in front of an elevator device, for retrieving and pulverizing the excavated material;

the elevator device, being attached to the frame immediately behind the drum, for receiving and transporting the excavated material to at least a first mesh screen;

the at least first mesh screen, attached to the frame and situated to receive the excavated material from the elevator device, for separating the excavated material into at least two grades of material;

means for transporting material that passes through the at least first mesh screen to the trench; and means for pulverizing and transporting material that fails to pass through the at least first mesh screen.

23. The apparatus of claim 22 wherein the elevator device is a belt-type elevator with paddles.

24. The apparatus of claim 22 further including a cover that is detachably attached to the frame and covers at least part of the elevator device and the mesh screen.

25. The apparatus of claim 22 wherein the mesh screen is approximately 3 inches by 3.5 inches and is coated with a ceramic coating.

26. The apparatus of claim 22 wherein the means for transporting material that fails to pass through the at least first mesh screen is a rotating drum, attached to the frame of the apparatus, that rotates in a direction to increase backward flow of particles too large to pass through the at least first mesh screen.

27. A trench-padding apparatus for maximizing conversion of excavated material to trench-padding material, wherein the trench-padding apparatus includes:

a lead assembly, comprising a feeder housing having a front rotating unit with protrusions, wherein the front rotating unit is attached to a frame of the trench-padding apparatus immediately in front of an elevator device, and the front rotating unit is adapted to force clumps of the excavated material between the front rotating unit and a base of the feeder housing to aid in reducing clump size; and a rear rotating unit, pivotally attached to a rearward portion of the frame of the trench-padding apparatus, that rotates in a direction to increase backward flow of excavation material too large to be used as padding material.

* * * * *